US008963911B2

(12) United States Patent
Nakamura

(10) Patent No.: US 8,963,911 B2
(45) Date of Patent: Feb. 24, 2015

(54) ELECTRO-OPTIC DEVICE AND ELECTRONIC APPARATUS

(71) Applicant: Seiko Epson Corporation, Tokyo (JP)

(72) Inventor: Teiichiro Nakamura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 101 days.

(21) Appl. No.: 13/924,699

(22) Filed: Jun. 24, 2013

(65) Prior Publication Data

US 2014/0009460 A1 Jan. 9, 2014

(30) Foreign Application Priority Data

Jul. 4, 2012 (JP) ..... 2012-150347

(51) Int. Cl.
*G09G 3/34* (2006.01)
*G09G 3/36* (2006.01)

(52) U.S. Cl.
CPC ..... *G09G 3/34* (2013.01); *G09G 3/3648* (2013.01); *G09G 3/3677* (2013.01); *G09G 2310/0286* (2013.01); *G09G 2310/08* (2013.01)
USPC ..... 345/214; 345/87; 345/107; 345/102; 359/315; 359/322

(58) Field of Classification Search
CPC ..... G09G 3/34
USPC ..... 345/214, 87, 102, 107; 359/322, 315
See application file for complete search history.

(56) References Cited

U.S. PATENT DOCUMENTS

| | | | | |
|---|---|---|---|---|
| 7,315,297 | B2 | 1/2008 | Murade | |
| 7,728,805 | B2 * | 6/2010 | Uekuri et al. | 345/96 |
| 7,868,883 | B2 | 1/2011 | Mochizuki et al. | |
| 2004/0245551 | A1 * | 12/2004 | Murade | 257/222 |
| 2007/0285383 | A1 * | 12/2007 | Iizuka | 345/103 |
| 2009/0052001 | A1 * | 2/2009 | Mochizuki | 359/259 |
| 2011/0037788 | A1 * | 2/2011 | Ohhashi | 345/690 |
| 2012/0050353 | A1 | 3/2012 | Ito | |
| 2012/0126237 | A1 * | 5/2012 | Masui | 257/71 |
| 2012/0162178 | A1 * | 6/2012 | Oh | 345/211 |
| 2013/0093743 | A1 * | 4/2013 | Takahashi et al. | 345/211 |

FOREIGN PATENT DOCUMENTS

| | | | |
|---|---|---|---|
| JP | 11-119742 | A | 4/1999 |
| JP | 2004-126551 | A | 4/2004 |
| JP | 2005-003988 | A | 1/2005 |
| JP | 2007-272162 | A | 10/2007 |
| JP | 2010-127955 | A | 6/2010 |
| JP | 2012-049645 | A | 3/2012 |

* cited by examiner

*Primary Examiner* — Kathy Wang-Hurst
*Assistant Examiner* — Dzung T Hoang
(74) *Attorney, Agent, or Firm* — ALG Intellectual Property, LLC

(57) ABSTRACT

A first constant potential wiring that supplies a first constant potential to a scanning line drive circuit and a second constant potential wiring that supplies the first constant potential to a clock buffer circuit are electrically separated from each other.

12 Claims, 8 Drawing Sheets

ELECTRO-OPTIC DEVICE AND ELECTRONIC APPARATUS

BACKGROUND

1. Technical Field

The present invention relates to an electro-optic device and an electronic apparatus.

2. Related Art

A projector is an electronic apparatus that emits light to a transmission type electro-optic device or a reflection type electro-optic device, and projects the transmitted light or reflected light which is modulated by such an electro-optic device, on a screen. The projector is configured such that light emitted from a light source is collected and incident on the electro-optic device, and then, the transmitted or reflected light which is modulated according to an electric signal is enlarged and projected on the screen via a projection lens. Thus, the projector has an advantage in displaying on the large screen. A liquid crystal device is known as the electro-optic device used in such an electronic apparatus. The liquid crystal device forms an image using a dielectric anisotropy of a liquid crystal and an optical rotation of the light in a liquid crystal layer.

JP-A-2004-126551 and JP-A-2005-3988 disclose examples of the liquid crystal device. In a circuit block diagram disclosed in FIG. 8 of JP-A-2004-126551, a scanning line and a data line are disposed in a display region. Pixels are arranged in a matrix at the intersection of the scanning line and the data line, and a scanning line drive circuit and a data line drive circuit which supply signals to each pixel are formed in the vicinity of the display region. In the scanning line drive circuit, a shift register circuit is included and a specific scanning line is selected among a plurality of scanning lines. A clock signal which is a basis of a drive operation and a reverse-phased clock signal which has an inverted phase with respect to the clock signal are supplied to the shift register circuit. It is desirable that the clock signal and the reverse-phased clock signal are accurate in the inverted phase. Therefore, a clock signal phase difference correction circuit to match the phases of both signals is provided.

Furthermore, in the liquid crystal device, depending on the method of displaying, there are one case in which the scanning line is selected one by one line, and the other case in which the scanning lines are selected two by two lines as disclosed in JP-A-2012-49645.

However, in a case where the method of displaying in which the scanning lines are selected two by two lines as disclosed in JP-A-2012-49645 is adopted to the liquid crystal device disclosed in JP-A-2004-126551 and JP-A-2005-3988, there appears a vertical band which bisects the display region in the horizontal side. In other words, in the electro-optic device in the related art, in some cases, there has been a difficulty in performing the high-quality image displaying.

SUMMARY

The invention can be realized in the following forms or application examples.

According to an application example, there is provided an electro-optic device in the application example including a scanning line, a signal line that intersects the scanning line, a scanning line drive circuit that supplies a selected potential or a non-selected potential to the scanning line, a pixel switching element that is provided corresponding to the intersection of the scanning line and the signal line, and that is in a conductive state in a case where the selected potential is applied to the scanning line and is in a non-conductive state in a case where the non-selected potential is applied to the scanning line, a clock buffer circuit that waveform-shapes a clock signal supplied to the scanning line drive circuit, a first constant potential wiring that supplies a first constant potential to the scanning line drive circuit and a second constant potential wiring that supplies the first constant potential to the clock buffer circuit. The first constant potential wiring and the second constant potential wiring are electrically separated.

A transistor configuring the clock buffer circuit has a large transistor capacity. Therefore, during the switching of the clock signal, charging and discharging with the large transistor capacity is performed, and thus there is a possibility that a large current may be instantaneously generated in the second constant potential wiring. That is, during the switching of the clock signal, there is a possibility that the potential of the second constant potential wiring may be instantaneously changed from the first constant potential. According to this configuration, the first constant potential wiring that supplies the first constant potential to the scanning line drive circuit and the second constant potential wiring that supplies the first constant potential to the clock buffer circuit are electrically separated from each other. Therefore, for example, even though the potential of the second constant potential wiring is changed, the potential of the first constant potential wiring can be kept in a normal range. That is, it is possible to suppress a power variation noise due to the switching of the clock signal from being placed on the scanning line drive circuit. As a result, a disturbance of the displayed image such as the vertical band appearing in the display region can be suppressed, and the high quality image display can be performed.

The electro-optic device may include a signal line drive circuit that supplies an image signal to the signal line and a third constant potential wiring that supplies the first constant potential to the signal line drive circuit. It is preferable that the first constant potential wiring, the second constant potential wiring and the third constant potential wiring be electrically separated from each other.

In this configuration, the first constant potential wiring that supplies the first constant potential to the scanning line drive circuit, the second constant potential wiring that supplies the first constant potential to the clock buffer circuit and the third constant potential wiring that supplies the first constant potential to the signal line drive circuit are electrically separated from each other. Therefore, for example, even though the potential of the second constant potential wiring is changed, the potential of the first constant potential wiring and the potential of the third constant potential wiring can be kept in a normal range. That is, it is possible to suppress the power variation noise due to the switching of the clock signal from being placed on the scanning line drive circuit and the signal line drive circuit. As a result, the disturbance of the displayed image can be suppressed, and the high quality image display can be performed.

The electro-optic device may include the signal line drive circuit that supplies the image signal to the signal line. It is preferable that the first constant potential be supplied to the signal line drive circuit from the first constant potential wiring.

In this configuration, the first constant potential wiring that supplies the first constant potential to the scanning line drive circuit and the signal line drive circuit, and the second constant potential wiring that supplies the first constant potential to the clock buffer circuit are electrically separated from each other. Therefore, for example, even though the potential of the second constant potential wiring is changed, the potential of the first constant potential wiring can be kept in a normal range. That is, it is possible to suppress the power variation noise due to the switching of the clock signal from being placed on the scanning line drive circuit and the signal line drive circuit. As a result, the disturbance of the displayed image can be suppressed, and the high quality image display can be performed.

In the electro-optic device, it is preferable that a protection capacitor be formed and the second constant potential wiring is electrically connected to the protection capacitor.

In this configuration, it is possible to increase a wiring capacitance of the second constant potential wiring. Therefore, even though a static electricity is induced to the second constant potential wiring, the increase in the potential due to the static electricity can be suppressed and it is possible to improve an electrostatic resistance. Thus, it is possible to realize the electro-optic device having the high electrostatic resistance by performing the high quality image displaying.

The electro-optic device may include a rectangular display region. It is preferable that the protection capacitor be formed outside the display region along three sides of the display region.

In this configuration, since the protection capacitor can be formed on the wide area outside the display region, the amount of the protection capacitor can be increased, and accordingly the wiring capacitance of the second constant potential wiring can also be increased. Since the increase in the potential due to the static electricity is more suppressed by the larger wiring capacitance, it is possible to improve the electrostatic resistance of the second constant potential wiring.

The electro-optic device may include an element substrate, an opposing substrate and a sealing material bonding the element substrate and the opposing substrate. It is preferable that the sealing material be disposed along the outer edge portion of the element substrate, and the protection capacitor and the sealing material be at least partially overlapped with each other in a plan view.

The sealing material is disposed on the relatively wide area outside the display region. In this configuration, since the protection capacitor can be formed on the region where the sealing material is disposed, the amount of the protection capacitor can be increased, and accordingly the wiring capacitance of the second constant potential wiring can also be increased. Since the increase in the potential due to the static electricity is more suppressed by the larger wiring capacitance, it is possible to improve the electrostatic resistance of the second constant potential wiring.

In the electro-optic device, it is preferable that the protection capacitor be formed in a banded shape in a plan view.

A metal electrode is used in the protection capacitor, which does not allow light to pass through. In this configuration, since the light passes through a banded gap even though the protection capacitor and the sealing material are overlapped with each other, a photo-curable resin can be used for the sealing material. That is, by using an ultraviolet curable resin for the sealing material, and by performing the high quality image displaying, it is possible to realize the electro-optic device having the high electrostatic resistance.

In the electro-optic device, it is preferable that an interlayer insulation film be formed and a dielectric film of the protection capacitor be the interlayer insulation film.

In this configuration, since the protection capacitor is formed on a thin film element, there is no need to mount an external capacitive element on the electro-optic device. Additionally, in forming the protection capacitor, there is no need to greatly change a structure and a manufacturing method of the electro-optic device using the interlayer insulation film. Thus, it is possible to easily form the protection capacitor using a highly reliable structure and manufacturing method.

In the electro-optic device, it is preferable that a common electrode wiring be formed, the second constant potential wiring be extended to one electrode of the protection capacitor, and the common electrode wiring be extended to the other electrode of the protection capacitor.

The common electrode wiring is disposed on the relatively wide area outside the display region. In this configuration, since the protection capacitor can be formed on the region where the common electrode wiring is disposed, the amount of the protection capacitor can be increased, and accordingly the wiring capacitance of the second constant potential wiring can be increased. Since the increase in the potential due to the static electricity is more suppressed by the larger wiring capacitance, it is possible to improve the electrostatic resistance of the second constant potential wiring.

In the electro-optic device such as the liquid crystal device or an electrophoretic display device, the pixel electrode is provided on the element substrate and the common electrode is provided on the opposing substrate, and then an electro-optic material such as a liquid crystal layer 15 or an electrophoretic material is provided between the pixel electrode and the common electrode. In a case where the common electrode wiring is disposed at the electrophoretic material side rather than the second constant potential wiring side in a cross-sectional view, the electrophoretic material is interposed between the common electrode wiring of the element substrate and the common electrode of the opposing substrate, and little electric field is applied. That is, little normal electric field is applied to the electrophoretic material, and little DC electricity flows in the electrophoretic material. Therefore, it is possible to prolong a durability of the electro-optic material.

In the electro-optic device, it is preferable that a fourth constant potential wiring supplies the second constant potential be formed, the second constant potential wiring is extended to one electrode of the protection capacitor, and the fourth constant potential wiring be extended to the other electrode of the protection capacitor.

A first power source or a second power source is a negative power source or a positive power source. During the switching of the clock signal, the clock buffer circuit performs discharging of the transistor capacity so as to increase the potential of the negative power source, and performs charging of the transistor capacity so as to decrease the potential of the positive power source. In this configuration, since the protection capacitor is formed on the fourth constant potential wiring and the second constant potential wiring, the potential increase of the negative power source and the potential decrease of the positive power source can be offset. That is, it is possible to improve the electrostatic resistance in the fourth constant potential wiring and the second constant potential wiring, and to significantly reduce the noise which is placed by the clock buffer circuit on the power source wiring.

In the electro-optic device, it is preferable that a capacitance amount of the protection capacitor be equal to or higher than three pico Farad (pF).

Various wirings used in the electro-optic device has a wiring capacitance of approximately from 10 pF to several hundred pF. Therefore, even though the electric charge amount caused by the static electricity is estimated as one nano coulomb (nC), the potential increase when the static electricity appears, is approximately from several V to 100 V, and the wirings do not undergo electrostatic destruction. In a case where the wiring capacitance of the second constant potential wiring is set equal to or higher than three pF, even though the electric charge amount caused by the static electricity is estimated as one nano coulomb (nC), the potential increase when the static electricity appears is equal to or lower than approximately 333 V. On the other hand, the dielectric film of the protection capacitor is equal to or larger than approximately 400 nano meter (nm) in thickness, and thus an insulation withstand voltage is equal to or higher than approximately 400 V. Therefore, in this configuration, even though the static electricity with the large amount of electrostatic charge appears in the second constant potential wiring, it is possible that the second constant potential wiring may not undergo the electrostatic destruction. That is, it is possible to improve the insulation withstand voltage of the second constant potential wiring up to a practical level.

An electronic apparatus includes the electro-optic device disclosed in the application examples described above.

In this configuration, it is possible to significantly reduce the noise which is placed by the clock buffer circuit on the power source wiring. In addition, since a clock signal generation circuit is not required, even though the method of displaying is adopted in which the scanning lines are selected two by two lines as disclosed in JP-A-2012-49645, and for example, the noise is placed on the second constant wiring, the potential of the first constant potential wiring and the third constant potential wiring can be kept in a normal range. That is, it is possible to suppress the power variation noise due to the switching of the clock signal from being placed on the scanning line drive circuit. As a result, a disturbance of the displayed image can be suppressed, and it is possible to realize the electronic apparatus which performs the image displaying with a high quality. Furthermore, it is possible to improve the insulation withstand voltage of the second constant potential wiring up to the practical level. In other words, it is possible to realize an electronic apparatus which performs the image displaying with the high quality and has reliability with respect to the practical static electricity.

BRIEF DESCRIPTION OF THE DRAWINGS

The invention will be described with reference to the accompanying drawings, wherein like numbers reference like elements.

FIG. 6A is a circuit configuration diagram and FIG. 6B is a timing chart thereof.

DESCRIPTION OF EXEMPLARY EMBODIMENTS

Hereafter, the embodiments of the invention will be described with reference to the drawings. In each of the drawings, in order to make the size of each layer or member large enough for easier recognition, a scale of each layer and member may be different from the actual scale.

Embodiment 1

Outline of Electro-Optic Device

Figure 1:
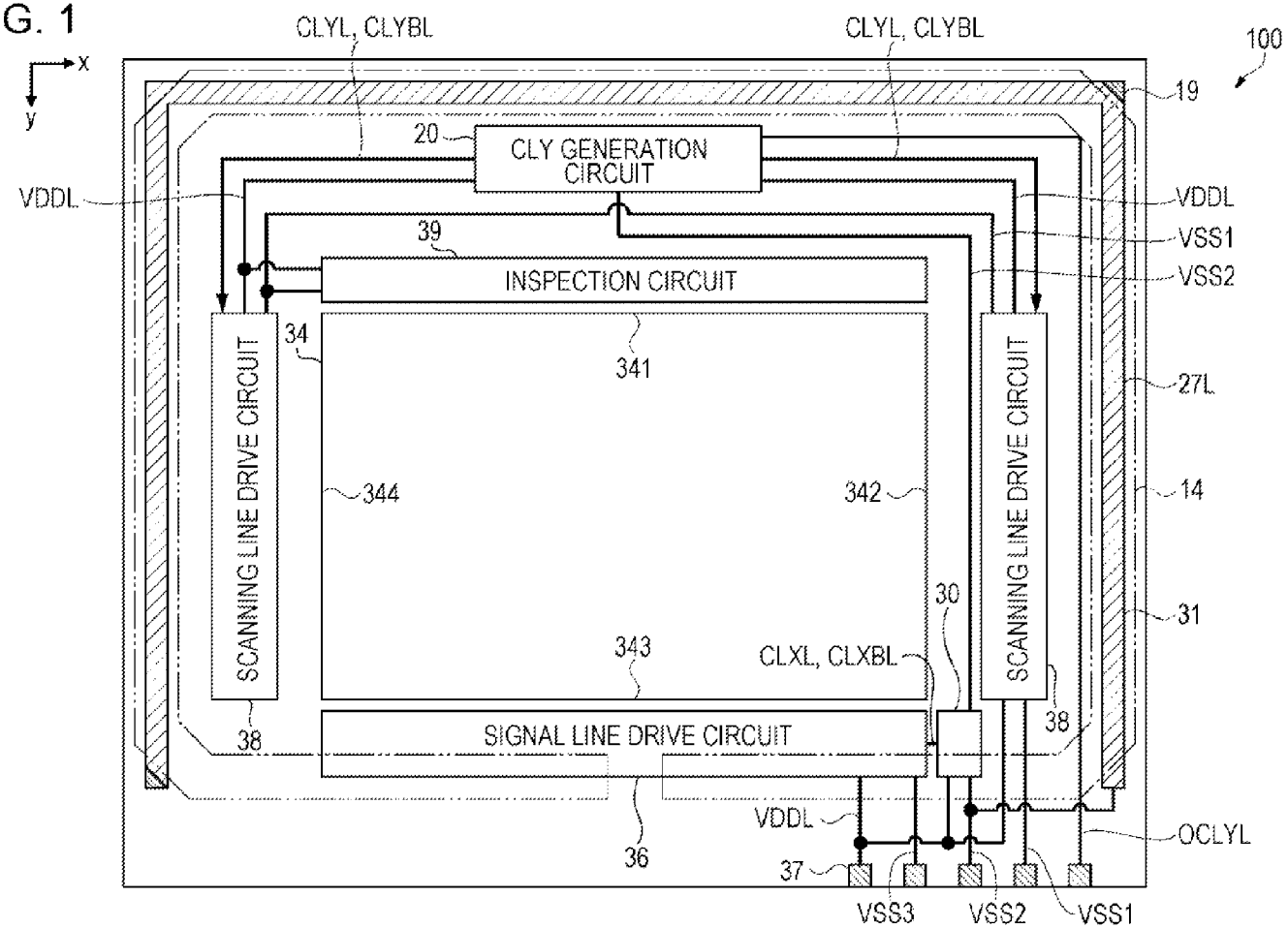
FIG. 1 is a circuit block diagram describing an outline of a liquid crystal device according to the embodiment 1.

FIG. 1 is a circuit block diagram describing an outline of a liquid crystal device according to the embodiment 1. Hereafter, the configuration of the electro-optic device will be described with reference to FIG. 1.

The electro-optic device includes an element substrate 12 (refer to FIG. 2), an opposing substrate 13 (refer to FIG. 2) and a sealing material 14. The sealing material 14 bonds the element substrate 12 and the opposing substrate 13, and interposes electro-optic material between the element substrate 12 and the opposing substrate 13. In the embodiment, the electro-optic material is liquid crystal, and the electro-optic device is the liquid crystal device 100. In the electro-optic device, various circuits are mainly formed on the element substrate 12, and FIG. 1 mainly illustrates the configuration of the element substrate 12. The liquid crystal device 100 is an active matrix type electro-optic device using a thin film transistor (called TFT element 46, refer to FIG. 3) as a switching element of a pixel 35 (refer to FIG. 3) (pixel switching element).

As illustrated in FIG. 1, the liquid crystal device 100 at least includes a rectangular display region 34, a scanning line drive circuit 38, a clock generation circuit 20 for the scanning line drive circuit (abbreviated as CLY generation circuit 20), an external connection terminal 37, a protection capacitor 31 and various wirings. In the embodiment, the liquid crystal device 100 further includes a signal line drive circuit 36, a clock generation circuit 30 for the signal line drive circuit (abbreviated as CLX generation circuit 30) and an inspection circuit 39. A pixel circuit is formed on the display region 34. The circuits, various wirings and external connection terminals 37 are formed on the element substrate 12 using a thin film layer. Various wirings will be described below. In FIG. 1, not all the wirings and external terminals 37 are illustrated, but, in order for easier explanation, only the typical wirings and the external connection terminals 37 are illustrated.

In the display region 34, the pixel 35 is provided in a matrix. The pixel 35 is a region specified by a scanning line 16 (refer to FIG. 3) and a signal line 17 (refer to FIG. 3) which intersect. One pixel 35 is a region from one scanning line 16 to a next scanning line 16 and from one signal line 17 to a next signal line 17. The display region 34 is a rectangle where a first side 341 (upper side) and a third side 343 (lower side) are along a first direction (x axis direction in the embodiment) and a second side 342 (right side) and a fourth side 344 (left side) are along a second direction (y axis direction in the embodiment). In addition, the first direction and the second direction intersect each other, and are orthogonal in the embodiment. In a region outside the display region 34, various circuits such as the signal line drive circuit 36 and the scanning line drive circuit 38 are formed.

The scanning line drive circuit 38 is respectively formed along two sides (the second side 342 and the fourth side 344) opposing each other at the outer edge of the display region 34 and includes a shift register circuit SR (refer to FIG. 6). From the external connection terminal 37 to the scanning line drive circuit 38, the first constant potential wiring VSS1, the fourth constant potential wiring VDDL and the shift register input wiring (not illustrated) are wired. The first constant potential wiring VSS1 supplies the first constant potential to the scanning line drive circuit 38, and the fourth constant potential wiring VDDL supplies the second constant potential to the scanning line drive circuit 38. In the embodiment, the first constant potential is the negative power source potential VSS, and the second constant potential is the positive power source potential VDD having a potential higher than the first constant potential. However, on the contrary, the first constant potential may be the positive power source potential VDD and the second constant potential may be the negative power source potential VSS having a potential lower than the first constant potential. The shift register input wiring is connected to an input unit of the shift register circuit SR and supplies the data Dt to the shift register circuit SR. In addition, in the scanning line drive circuit 38, a clock line CLYL for the scanning line drive circuit (abbreviated as Y clock line CLYL) which supplies a clock signal CLY for the scanning drive circuit (abbreviated as Y clock signal CLY) from the CLY generation circuit 20, and an inverted clock line CLYBL for the scanning line drive circuit (abbreviated as Y clock bar line CLYBL) which supplies an inverted clock signal CLYB for the scanning line drive circuit (abbreviated as Y clock bar signal CLYB) from the CLY generation circuit 20, and the like, are wired. The scanning line drive circuit 38 supplies a selected potential or a non-selected potential to the scanning lines 16, and selects a specific scanning line 16 from the plurality of scanning lines 16.

The signal line drive circuit 36 is formed along one side (the third side 343) where the scanning line drive circuit 38 is not formed at the outer edge of the display region 34, and includes the shift register circuit SR. From the external connection terminal 37 to the signal line drive circuit 36, the third constant potential wiring VSS3, the fourth constant potential wiring VDDL and the shift register input wiring (not illustrated) and video wirings (not illustrated) are wired. The third constant potential wiring VSS3 supplies the first constant potential (the negative power source potential VSS) to the signal line drive circuit 36, and the fourth constant potential wiring VDDL supplies the second constant potential (the positive power source potential VDD) to the signal line drive circuit 36. In addition, in the signal line drive circuit 36, a clock line CLXL for the signal line drive circuit (abbreviated as X clock line CLXL) which supplies a clock signal CLX for the signal drive circuit (abbreviated as X clock signal CLX) from the CLX generation circuit 20, and an inverted clock line CLXBL for the signal line drive circuit (abbreviated as X clock bar line CLXBL) which supplies an inverted clock signal CLXB for the signal line drive circuit (abbreviated as X clock bar signal CLXB) from the CLX generation circuit 30, and the like, are wired. The signal line drive circuit 36 supplies an image signal to the signal line 17.

The inspection circuit 39 is formed along one side (the first side 341) neighboring the display region 34, and is connected to each signal line 17. The inspection circuit 39 has a similar configuration to the signal line drive circuit 36 and includes the shift register circuit SR. In the inspection circuit 39, the first constant potential wiring VSS1 and the fourth constant potential wiring VDDL, the shift register input wiring (not illustrated) and an inspection output wiring (not illustrated), a clock line for the inspection circuit 39, an inverted clock line for the inspection circuit 39 and the like, are wired. The first constant potential wiring VSS1 supplies the first constant potential (the negative power source potential) to the inspection circuit 39, and the fourth constant potential wiring VDDL supplies the second constant potential (the positive power source potential VDD) to the inspection circuit 39. The inspection circuit 39 sequentially selects the signal lines 17 to output an inspection signal to the inspection output wiring. A disconnection of the signal line 17, a short circuit between the signal line 17 and the scanning line 16, a defect in the pixel 35 and the like are inspected by the inspection circuit 39. The inspection circuit 39 is connected to each signal line 17 and has a similar configuration to the signal line drive circuit 36, thus, the inspection circuit 39 is formed along one side (the first side 341) facing the signal line drive circuit 36.

The CLY generation circuit 20 is formed between the display region 34 and the inspection circuit 39 and the outer edge of the element substrate 12, and supplies the Y clock signal CLY and the Y clock bar signal CLYB to the scanning line drive circuit 38. The scanning line drive circuit 38 is formed on both sides of the display region 34 and thus the CLY generation circuit 20 is formed on almost the center in the x axis direction of the display region 34. As a result, a distance between the scanning line drive circuit 38 disposed along the second side 342 and the CLY generation circuit 20, and a distance between the scanning line drive circuit 38 disposed along the fourth side 344 and the CLY generation circuit 20 are almost same. Thus, it is possible to drive both scanning line drive circuits 38 by the Y clock signal CLY having a same signal delay and the Y clock bar signal CLYB having a same signal delay. The CLY generation circuit 20 includes the clock buffer circuit 203 (refer to FIG. 4) which waveform-shapes of the Y clock signal CLY and Y clock bar signal CLYB. From the external connection terminal 37 to the CLY generation circuit 20, the second constant potential wiring VSS2 and the fourth constant potential wiring VDDL, an original Y clock line OCLYL and the like are wired, and the Y clock line CLYL and the Y clock bar line CLYBL are disposed for outputs. The second constant potential wiring VSS2 supplies the first constant potential (the negative power source potential VSS) to the CLY generation circuit 20. Therefore, the second constant potential wiring VSS2 supplies the first constant potential (the negative power source potential VSS) to the clock buffer circuit 203. The fourth constant potential wiring VDDL supplies the second constant potential (the positive power source potential) to the CLY generation circuit 20, and the original Y clock line OCLYL supplies the original clock signal for Y OCLY to the CLY generation circuit 20. The CLY generation circuit 20 generates the Y clock signal CLY and the Y clock bar signal CLYB from the original clock signal for Y OCLY, and supplies the Y clock signal CLY and the Y clock bar signal CLYB to the scanning line drive circuit 38 via the Y clock line CLYL and the Y clock bar line CLYBL.

The CLX generation circuit 30 is formed on the outer region of the display region 34, and supplies the X clock signal CLX and the X clock bar signal CLXB to the signal line drive circuit 36. The CLX generation circuit 30 has a configuration almost same as that of the CLY generation circuit 20. From the external connection terminal 37 to the CLX generation circuit 30, the second constant potential wiring VSS2 and the fourth constant potential wiring VDDL, an original X clock line (not illustrated) and the like are wired, and the X clock line CLXL and the X clock bar line CLXBL are disposed for outputs. The second constant potential wiring VSS2 supplies the first constant potential (the negative power source potential VSS) to the CLX generation circuit 30. The fourth constant potential wiring VDDL supplies the second constant potential (the positive power source potential VDD) to the CLX generation circuit 30, and the original X clock line (not illustrated) supplies the original clock signal for X to the CLX generation circuit 30. The CLX generation circuit 30 generates the X clock signal CLX and the X clock bar signal CLXB from the original clock signal for X, and supplies the X clock signal CLX and the X clock bar signal CLXB to the signal line drive circuit 36 via the X clock line CLXL and the X clock bar line CLXBL.

In this way, three types of the first power source wiring which supplies a first constant potential to each circuit are electrically separated with the first constant potential wiring VSS1, the second constant potential wiring VSS2 and the third constant potential wiring VSS3 in the electro-optic device. The transistor configuring the clock buffer circuit 203 has a large transistor capacity. Therefore, during the switching of the Y clock signal CLY and the Y clock bar signal CLYB, a charging and discharging of the large capacity of the transistor are performed, and thus there is a possibility that a large current is instantaneously generated in the second constant potential wiring VSS2. That is, during the switching of the Y clock signal CLY and the Y clock bar signal CLYB, there is a possibility that the potential of the second constant potential wiring VSS2 changes from the first constant potential. As described above, in a case where the first constant potential wiring VSS1 that supplies the first constant potential to the scanning line drive circuit 38 and the second constant potential wiring VSS2 that supplies the second constant potential to the clock buffer circuit 203 and the third constant potential wiring VSS3 that supplies the first constant potential to the signal line drive circuit 36 are electrically separated, for example, even though the potential of the second constant potential wiring changes, the potential of the first constant potential wiring VSS1 and the third constant potential wiring VSS3 can be kept in a normal range. Therefore, it is possible to suppress the power variation noise due to the switching of the Y clock signal CLY and the Y clock bar signal CLYB from being placed on the scanning line drive circuit 38 and the signal line drive circuit 36. As a result, a disturbance of the displayed image can be suppressed, and the high quality image display can be performed.

The second constant potential wiring VSS2 is electrically connected to the CLY generation circuit 20 and the CLX generation circuit 30. However, between the external connection terminal 37 of the second constant potential wiring VSS2 and the CLX generation circuit 30, the protection capacitor 31 is electrically connected. The capacitance of the protection capacitor 31 is equal to or higher than three pico Farad (pF). Since the second constant potential wiring VSS2 is electrically connected to the CLY generation circuit 20 from external connection terminal 37 via the CLX generation circuit 30, the protection capacitor 31 is electrically connected between the external connection terminal 37 of the second constant potential wiring VSS2 and the CLY generation circuit 20. In this way, it is possible to increase a wiring capacitance of the second constant potential wiring VSS2 to some extent. In a case where the protection capacitor 31 is not connected to the second constant potential wiring VSS2, since the first constant potential wiring VSS1, the second constant potential wiring VSS2 and the third constant potential wiring VSS3 are independent of each other, the wiring capacitance of the second constant potential wiring VSS2 becomes approximately as small as 300 femto Farad (fF) to 400 fF. If the wiring capacitance of the second constant potential wiring VSS2 is small like this, there is a possibility that the CLY generation circuit 20 and the CLX generation circuit 30 may be destroyed by the static electricity. Specifically, various wirings used in the electro-optic device usually have the wiring capacitance of approximately 10 pF to several hundred pF. Therefore, even the electric charge amount of the static electricity is estimated as one nano coulomb (nC), the increase of the potential when the static electricity appears is approximately several volts to 100 V, which cannot cause an electrostatic destruction. However, if the wiring capacitance is approximately 300 pF, the increase of the potential when the same electric charge amount of the static electricity appears becomes equal to or more than 3000 V, there is a possibility of electrostatic destruction of the circuits and the wirings. On the contrary, in the embodiment, in a case where the protection capacitor 31 with equal to or higher than three pF is electrically connected to the second constant potential wiring VSS2, even though the static electricity having one nC of electric charge amount is induced to the second constant potential wiring VSS2, the increase of the potential in the second constant potential wiring VSS2 due to the static electricity is equal to or lower than approximately 333 V. The increase of the potential due to the static electricity can be suppressed, thus, it is possible to improve the electrostatic resistance of the CLY generation circuit 20 and the CLX generation circuit 30. As described below, since the dielectric film of the protection capacitor 31 is equal to or larger than approximately 400 nm, the insulation withstand voltage of the protection capacitor 31 is approximately equal to or higher than 400 V. Accordingly, the static electricity having the large electric charge of equal to or more than one nC is induced to the second constant potential wiring VSS2, the electrostatic destruction does not occur in the second constant potential wiring VSS2, and the insulation withstand voltage of the second constant potential wiring VSS2 is improved up to a practical level.

Furthermore, since the static electricity is easily induced from the external connection terminal 37, in a case where the protection capacitor 31 is connected between the external connection terminal 37 and the CLX generation circuit 30, or between the external connection terminal 37 and the CLY generation circuit 20, the CLX generation circuit 30 and the CLY generation circuit 20 are effectively protected from the static electricity. It may be understood that, for example, in a case where the protection capacitor 31 is connected to the tip of the CLX generation circuit 30 when viewed from the external connection terminal 37, the static electricity induced from the external connection terminal 37 causes an electrostatic destruction of the CLX generation circuit 30 and then the protection capacitor 31 operates. Thus the CLX generation circuit 30 cannot be protected.

As illustrated in FIG. 1, the protection capacitor 31 is formed along the three sides of the display region 34. More specifically, the sealing material 14 is disposed on a relatively wide area of an outer side of the display region 34 so as to surround the display region 34. However, the protection capacitor 31 is disposed so as to at least partially overlap the sealing member 14 in a plan view. That is, the protection capacitor 31 is disposed so as to at least partially overlap the sealing member 14 which is disposed along the outer edge portion of the element substrate 12. In this way, since the protection capacitor 31 can be disposed on the wide area of the outer side of the display region 34, the capacitance of the protection capacitor 31 can be increased and, accordingly, it is possible to increase the wiring capacitance of the second constant potential wiring VSS2. Since the increase of the potential due to the static electricity is more suppressed by the larger wiring capacitance, it is possible to increase the electrostatic resistance of the second constant potential wiring VSS2. AS described above, in order to increase the insulation withstand voltage of the protection capacitor 31, the dielectric film is formed to be equal to or larger than approximately 400 nm in thickness using the interlayer insulation film. In this way, since the capacitance value per unit area is decreased, in the embodiment, the capacitance value of the protection capacitor 31 can be large enough by forming the protection capacitor 31 on the wide area where the sealing material 14 is formed and widening the area of the protection capacitor 31.

In the electro-optic device such as the liquid crystal device 100 or an electrophoretic display device, the pixel electrode 42 is provided on the element substrate 12 and the common electrode 27 is provided on the opposing substrate 13, and an electro-optic material such as a liquid crystal layer 15 or an electrophoretic material is provided in between the pixel electrode 42 and the common electrode 27. A common electrode 27 potential is supplied to the common electrode 27 provided on the opposing substrate 13 via a vertical conduction material, and a common electrode wiring 27L is formed on the element substrate 12. The common electrode wiring 27L is formed on the region where the sealing material 14 is formed, so that the sealing material 14 surrounds the three sides of the display region 34. Here, in a case where one electrode of the protection capacitor 31 is set to be the second constant potential wiring VSS2 and the other electrode of the protection capacitor 31 is set to be the common electrode wiring 27L, the protection capacitor 31 can be formed on the region where the sealing material 14 is formed and the common electrode wiring 27L is disposed, and the amount of the protection capacitor 31 is increased, and accordingly, the wiring capacitance of the second constant potential wiring VSS2 can also be increased. That is, the second constant potential wiring VSS2 which is one electrode of the protection capacitor 31 is extended to the region where the sealing material 14 is formed, and the common electrode wiring 27L which is the other electrode of the protection 31 is also extended to the region where the sealing material 14 is formed. Both are overlapped on the region where the sealing material 14 is formed in a plan view, and the dielectric film is interposed therebetween to become the protection capacitor 31.

Cross-Sectional Structure of Electro-Optic Device

Figure 2:
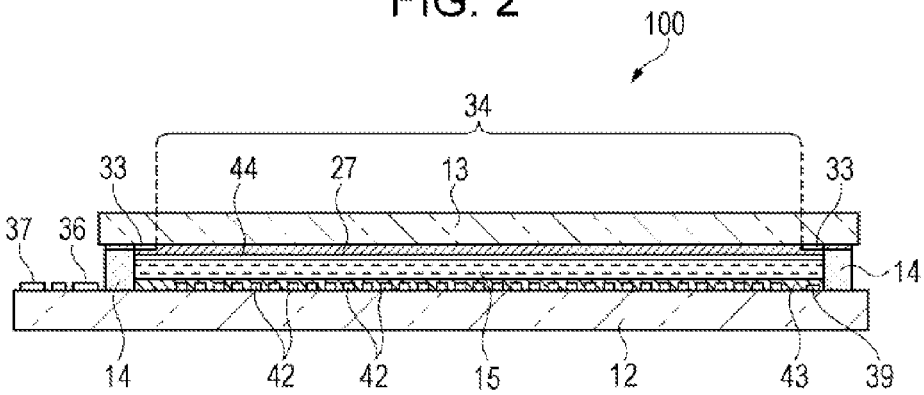
FIG. 2 is a schematic cross-sectional diagram of the liquid crystal device.

FIG. 2 is a schematic cross-sectional diagram of a liquid crystal device 100. Hereafter, the structure of the liquid crystal device 100 will be described with reference to FIG. 2. In addition, in the aspects below, if something is described as "on the ○○", it means, "a case where something is disposed so as to contact on the ○○", or "a case where something is disposed via another constituents on the ○○" or "a case where a part of something is disposed so as to contact on the ○○ and a part of something is disposed via another constituents on the ○○".

In the liquid crystal device 100, the element substrate 12 and the opposing substrate 13 that configure a pair of substrates are bonded by the sealing material 14 disposed in a substantially rectangular frame in a plan view. The liquid crystal 100 has a configuration in which a liquid crystal layer 15 is enclosed in the region surrounded by the sealing material 14. For the liquid crystal layer 15, for example, a liquid crystal material having a positive dielectric anisotropy is used. In the liquid crystal device 100, a light blocking film 33 having a rectangular frame shape in a plan view, made of a light blocking material is formed on the opposing substrate 13 along the inner peripheral vicinity of the sealing material 14. The inner side region of the light blocking film 33 is the display region 34. The light blocking film 33, for example, is formed of a light blocking material which is aluminum (Al), and is provided so as to partition the outer periphery of the display region 34 in the opposing substrate 13 side, and further, as described above, provided so as to oppose the scanning line 16 and the signal line 17 in the display region 34.

As illustrated in FIG. 2, in the liquid crystal 15 side of the element substrate 12, a plurality of pixel electrodes 42 are formed, a first orientation film 43 is formed so as to cover the pixel electrodes 42. The pixel electrode 42 is a conductive film made of a transparent conductive material such as indium tin oxide (ITO). On the other hand, in the liquid crystal 15 side of the opposing substrate 13, the lattice-shaped light blocking film 33 is formed, and the plan beta-shaped common electrode 27 is formed on the light blocking film 33. Then, on the common electrode 27, a second orientation film 44 is formed. The common electrode 27 is a conductive film formed of the transparent conductive material such as ITO.

The liquid crystal device 100 is a transmission type, and is used in disposing a polarizing plate (not illustrated) on the light incident side and light emitting side of the element substrate 12 and the opposing substrate 13, respectively. In addition, the structure of the liquid crystal device 100 is not limited to this, a reflection type or a semi-transmission type may be used.

Circuit Configuration

Figure 3:
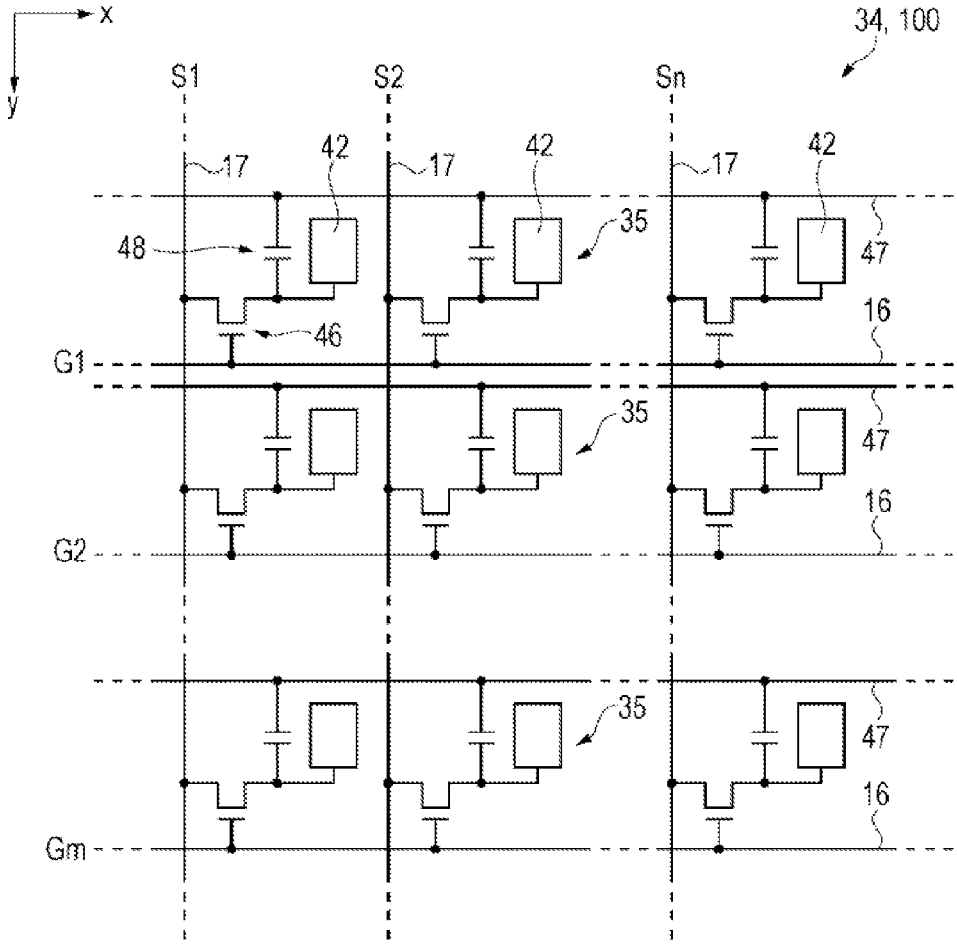
FIG. 3 is an equivalent circuit diagram illustrating an electric configuration of the liquid crystal device.

FIG. 3 is an equivalent circuit diagram illustrating an electric configuration of the liquid crystal device 100. Hereafter, the electric configuration of the liquid crystal device will be described with reference to FIG. 3.

AS illustrated in FIG. 3, the liquid crystal device 100 includes a plurality of pixels 35 which configure the display region 34. On each pixel 35, each pixel electrode 42 is disposed. In addition, in the pixel 35, the TFT element 46 is formed.

The TFT element 46 is a pixel switching element which performs a conduction control to the pixel electrode 42. To a source side of the TFT element 46, the signal lines 17 are electrically connected. The configuration is formed so that the image signals S1, S2, . . . , Sn from the signal line drive circuit 36 are supplied to the signal line 17.

In addition, to a gate side of the TFT element 46, the scanning line 16 is electrically connected. The configuration is formed so that the scanning signals G1, G2, . . . , Gm from the scanning line drive circuit 38 are supplied to the scanning line 16 as a pulse at a pre-determined timing. In addition, to a drain side of the TFT element 46, the pixel electrode 42 is electrically connected.

The scanning signals G1, G2, . . . , Gm supplied from the scanning line 16 are the selected potential with respect to the pixel switching element, and the pixel switching element is in a conductive state when the selected potential is applied and is in a non-conductive state when the non-selected potential is applied. That is, since the TFT element 46 which is a switching element is in an ON state only for a certain period of time when the selected potential is applied, the image signals S1, S2, . . . , Sn supplied from the signal line 17 are written into the pixels 35 via the pixel electrode 42 at a pre-determined timing.

The image signals S1, S2, . . . , Sn with the pre-determined potential written into the pixels 35 are retained for a certain period of time with a liquid crystal capacity formed between the pixel electrode 42 and the common electrode 27 (refer to FIG. 2). Furthermore, the decrease of the potential of the retained image signals S1, S2, . . . , Sn may be suppressed by the leakage current, and the retention capacity 48 is formed between the pixel electrode 42 and the capacity line 47.

When the voltage signal is applied to the liquid crystal layer 15, the orientation state of the liquid crystal molecules is changed according to the applied voltage level. Accordingly, the light incident on the liquid crystal layer 15 is modulated and the image light is generated.

CLY Generation Circuit

Figure 4:
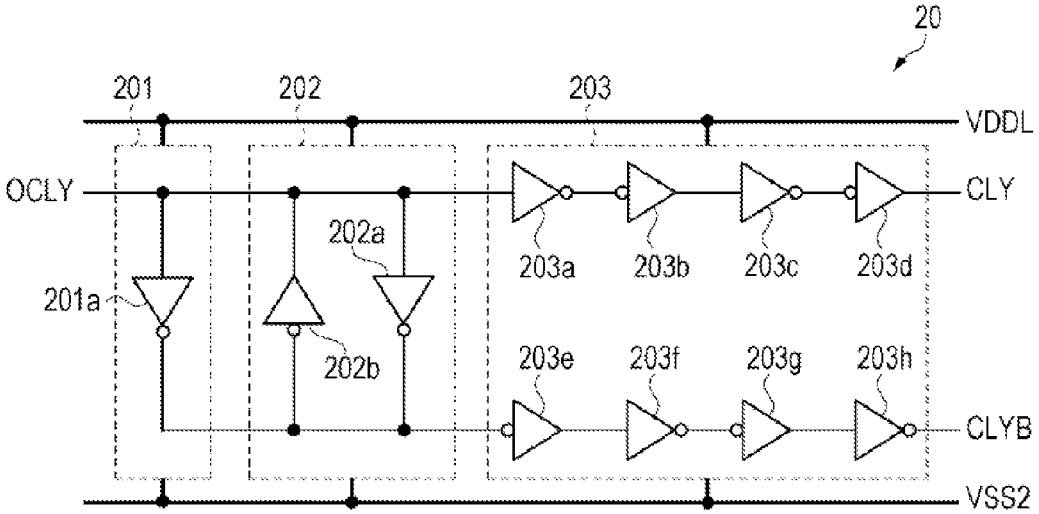
FIG. 4 is an equivalent circuit diagram illustrating an electric configuration of a CLY generation circuit.
Figure 5:
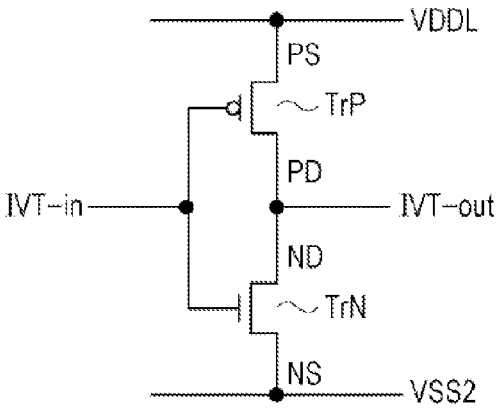
FIG. 5 is an equivalent circuit diagram illustrating an electric configuration of an inverter.

FIG. 4 is an equivalent circuit diagram illustrating an electric configuration of the CLY generation circuit. In addition, FIG. 5 is an equivalent circuit diagram illustrating an electric configuration of an inverter. Hereafter, the electric configuration of the CLY generation circuit 20 will be described with reference to the FIGS. 4 and 5.

The CLY generation circuit 20 generates the Y clock signal CLY and the Y clock bar signal CLYB from the original clock signal for Y OCLY, and supplies the Y clock signal CLY and the Y clock bar signal CLYB to the scanning line drive circuit 38 via the Y clock line CLYL and the Y clock bar line CLYBL. Furthermore, the CLX generation circuit 30 also has an almost the same configuration as the CLY generation circuit 20. In the description below, "Y" is replaced with "X" and the "scanning line drive circuit 38" is replaced with the "signal line drive circuit 36", then the CLX generation circuit 30 may be described.

As illustrated in FIG. 4, the CLY generation circuit 20 is configured to include an inverted signal generation circuit 201, a phase difference correction circuit 202 and the clock buffer circuit 203. The inverted signal generation circuit 201 includes an inverter 201*a*. The phase difference correction circuit 202 includes a pair of inverters 202*a* and 202*b* in a mutual feedback state. In the clock buffer circuit 203, inverters 203*a*, 203*b*, 203*c* and 203*d* are serially connected to the lines which output the Y clock signals CLY, and inverters 203*e*, 203*f*, 203*g* and 203*h* are serially connected to the lines which output the Y clock bar signals CLYB.

The inverted signal generation circuit 201 generates a reverse-phased signal to the original clock signal for Y OCLY using the inverter 201*a* from the original clock signal for Y OCLY, and supplies the original clock signal for Y OCLY and the reverse-phased signal to the original clock signal for Y OCLY to the phase difference correction circuit 202.

The reverse-phased signal in the original clock signal for Y OCLY is delayed in phase for the time of passing through the inverter 201*a* compared to the original clock signal for Y OCLY. Thus, the phase difference correction circuit 202 corrects the phase difference so that the phase difference may be eliminated. Specifically, in the configuration, the phase difference can be eliminated or decreased, by supplying the output of the inverter 202*a* of the phase difference correction circuit 202 to the input of the other inverter 202*b*, or the output of the other inverter 202*b* to the input of one inverter 202*a* respectively, and by putting the positive feedback to the input signals of each of the inverters 202*a* and 202*b* respectively.

Furthermore, in the latter part of the phase difference correction circuit 202, the clock buffer circuit 203 is provided. The low drive capability of the phase difference correction circuit 202 is increased by the clock buffer circuit 203. That is, the clock buffer circuit 203 waveform-shapes the output from the phase difference correction circuit 202 to form the Y clock signal CLY and the Y clock bar signal CLYB. In a case where the signal from the phase difference correction circuit 202 is supplied to the Y clock line CLYL and the Y clock bar line CLYBL respectively, by the wiring capacitance in the Y clock line CLYL and the Y clock bar line CLYBL, the Y clock signal CLY and the Y clock bar signal CLYB become smooth dull signals. In order to prevent this, a sharp signal is formed. The signal output from by waveform-shaping the clock buffer circuit 203 becomes sharper to the extent that the ON resistance of the transistor which configures the last inverters (inverters 203*d* and 203*h* in the embodiment) of the clock buffer circuit 203 is lower. For this purpose, the width of the inverters 203*a*, 203*b*, 203*c* and 203*d* and the transistors which configure the inverters are made large. Similarly, the width of the inverters 203*e*, 203*f*, 203*g* and 203*h* and the transistors which configure the inverters is made large. Thus, generally, at the time when the Y clock signal CLY and the Y clock bar signal CLYB are switched, a large current is generated instantaneously. In addition, the difference between the original clock signal for Y OCLY and the Y clock signal CLY is a waveform-shaping of the delay time of passing through the clock buffer circuit 203 and the signal.

As illustrated in FIG. 5, in the inverter used in the CLY generation circuit 20, a P-type transistor TrP and an N-type transistor TrN are disposed between the positive power source VDD and the negative power source VSS. The positive power source VDD is supplied to the P-type transistor TrP and the negative power source VSS is supplied to the N-type transistor TrN. The gates of the P-type transistor TrP and the N-type transistor TrN are the inverter input IVT-in, and the drain PD of the P-type transistor TrP and the drain ND of the N-type transistor TrN are the inverter output IVT-out. In the inverters in the CLY generation circuit 20, the source PS of the P-type transistor TrP is electrically connected to the fourth constant potential wiring VDDL, and the source NS of the N-type transistor TrN is electrically connected to the second constant potential wiring VSS2.

Furthermore, in a case where a terminal 1 and a terminal 2 are electrically connected, it means that the terminal 1 and the terminal 2 are directly connected by wiring, and also it includes a case of the connection via a resister element or a switching element. That is, even though a potential in the terminal 1 and a potential in the terminal 2 are slightly different from each other, in a case where it has a same meaning in the circuit, it can be regarded that they are electrically connected. For example, the inverter output IVT-out and the second constant potential wiring VSS2 illustrated in FIG. 5 are electrically connected. Actually, the N-type transistor TrN intervenes between the inverter output IVT-out and the second constant potential wiring VSS2. However, in a case where the N-type transistor TrN is in an ON state, since it means that the potential of the inverter output IVR-out is almost the same as the potential of the second constant potential wiring VSS2, it can be said that the inverter output IVT-out and the second constant potential wiring VSS2 are electrically connected.

In addition, in the embodiment, the Y clock signal CLY and the Y clock bar signal CLYB are created from the original clock signal for Y OCLY. Accordingly, the CLY generation circuit 20 includes the inverted signal generation circuit 201, the phase difference correction circuit 202 and the clock buffer circuit 203. On the other hand, in a case where the original clock signal for Y OCLY and the reverse-phased original clock bar signal for Y are supplied, the inverted signal generation circuit 201 and the phase difference correction circuit 202 may be omitted from the CLY generation circuit 20. Or, the inverted signal generation circuit 201 may be omitted from the CLY generation circuit 20. That is, in a case where the original clock signal for Y OCLY and the original clock bar signal for Y are supplied, the CLY generation circuit 20 may at least includes the clock buffer circuit 203.

Scanning Line Drive Circuit and Signal Line Drive Circuit

Figure 6B:
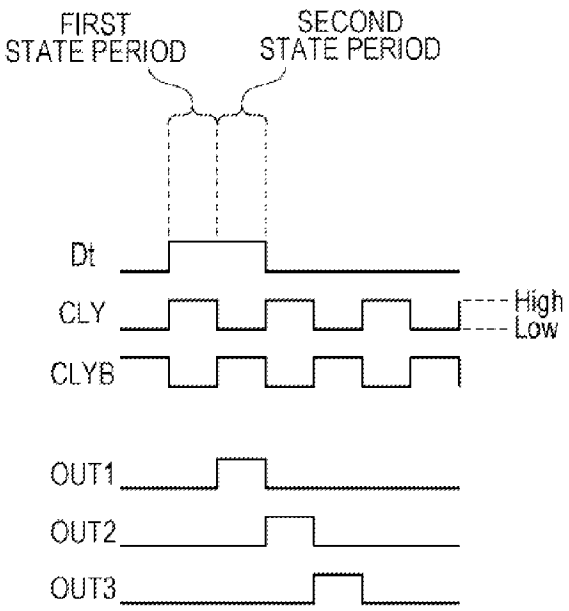
FIGS. 6A and 6B illustrate a scanning line drive circuit.
Figure 6A:
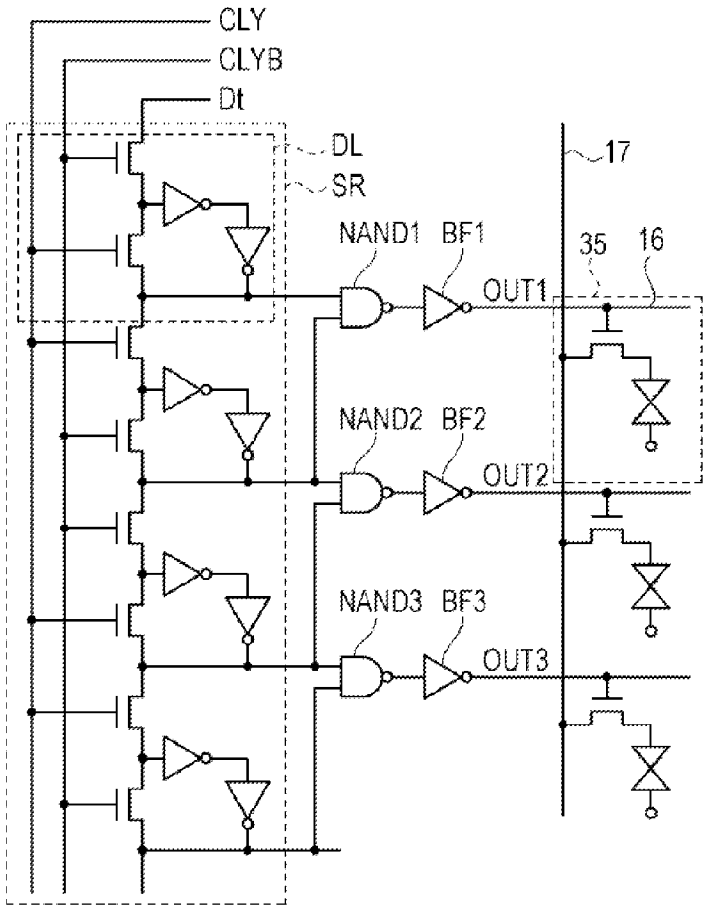

FIGS. 6A and 6B explain the scanning line drive circuit. FIG. 6A is a circuit configuration diagram and FIG. 6B is a timing chart thereof. Hereafter, the scanning line drive circuit 38 and the signal line drive circuit 36 will be described with reference to the FIGS. 6A and 6B.

As illustrated in FIG. 6A, the scanning line drive circuit 38 includes the shift register circuit SR, a NAND circuit NAND and an output buffer circuit BF. A D-latch circuit DL is serially connected to the shift register circuit SR. In the shift register circuit SR, as illustrated in FIG. 6A, the Y clock signal CLY and the Y clock bar signal CLYB are supplied to transfer the data Dt input to the shift register circuit SR. The output of the neighboring D-latch circuit DL is received by the NAND circuit NAND, and the output of the NAND circuit NAND is waveform-shaped in the output buffer circuit BF to be output to the scanning line 16 as a selected signal or the non-selected signal. The Y clock signal CLY and the Y clock bar signal CLYB are mutually complementary as illustrated in FIG. 6B, and when one is in a first state (High), the other is in a second state (Low). The Y clock signal CLY and the Y clock bar signal CLYB are generated in the CLY generation circuit 20 described above, and have the sharp waveforms with mutually reverse phases. As for the Y clock signal CLY and the Y clock bar signal CLYB, one cycle is composed of the first state period and the second state period and the data Dt is transferred to the next stage every half cycle.

A transistor connected to the Y clock line CLYL and a transistor connected to the Y clock bar line CLYBL are included in each D-latch circuit DL. The minimum number of the required D-latch circuits DL is the number of the scanning lines 16 plus one. For example, in a case of a high vision TV having 1090 scanning lines 16, at least 1091 D-latch circuits are required. The scanning line drive circuit 38 includes many D-latch circuits DL like this, hence, the wiring capacitance of the Y clock signal CLYL and the Y clock bar signal CLYBL becomes large, and the clock buffer circuit 203 is required in the CLY generation circuit 20 as described above.

The signal line drive circuit 36 has a similar configuration to the scanning line drive circuit 38, and is further configured to additionally include a sample-hold circuit (not illustrated). That is, the sample-hold circuit is electrically connected to the output buffer circuit BF, and samples and holds the video signal to supply to each signal line 17 according to the selected signal from the output buffer circuit BF.

Cross-Sectional Structure of Protection Capacitor

Figure 7:
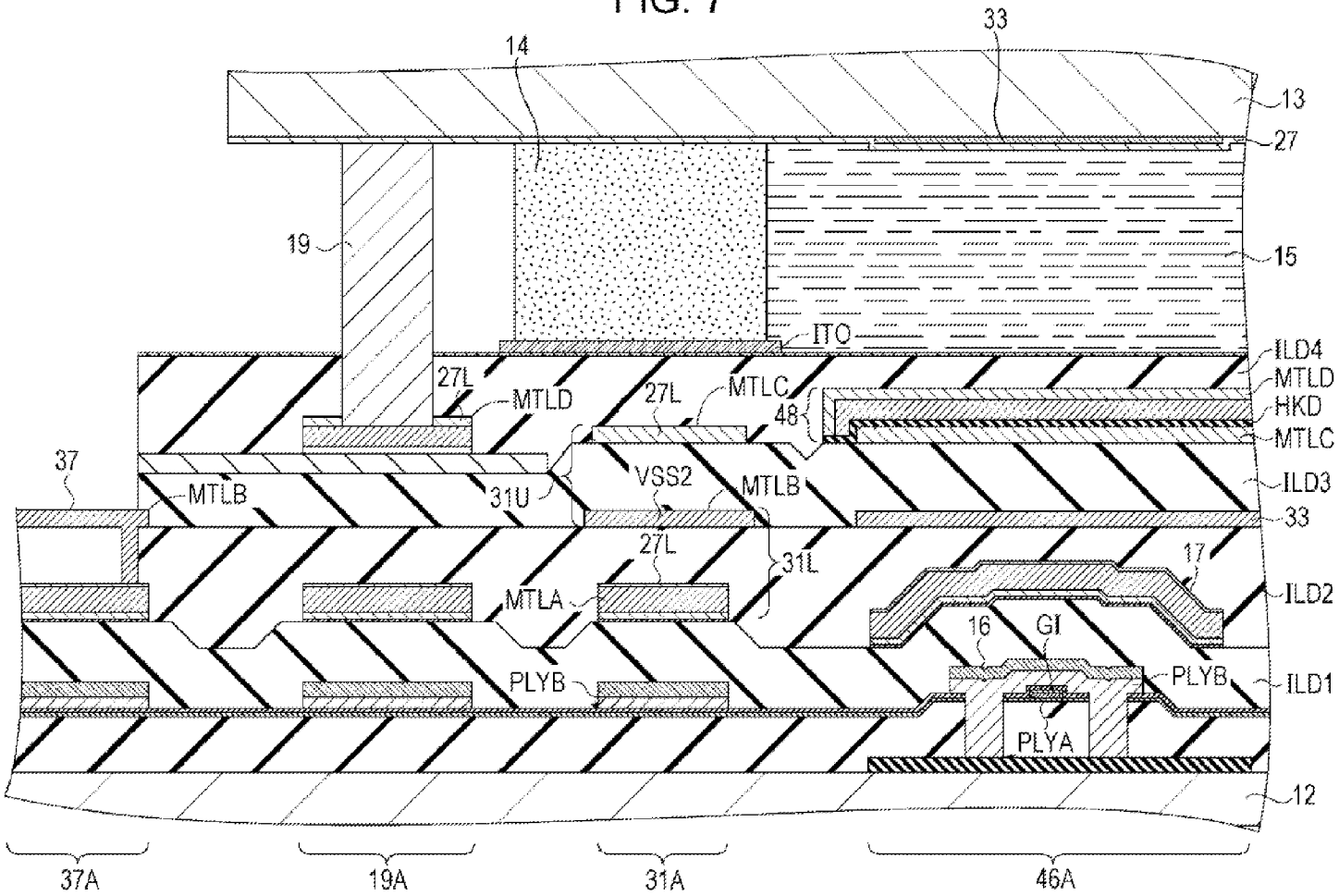
FIG. 7 is a schematic cross-sectional view of the liquid crystal device.

FIG. 7 is a schematic cross-sectional view of the liquid crystal device. Hereafter, the cross-sectional structure of the protection capacitor 31 will be described with reference to FIG. 7. Here in FIG. 7, in order for easier understanding, a portion where the external connection terminal 37 is formed (external connection terminal unit 37A), a portion where the vertical conduction materials 19 are formed (vertical conduction unit 19A), a portion where the protection capacitor 31 is formed (protection capacitor unit 31A) and a portion where the TFT element 46 is formed (TFT unit 46A) are drawn side by side.

As illustrated in FIG. 7, in the TFT element 46 which is a pixel switching element, a gate insulation film covers an active semiconductor film PLYA (a polycrystalline silicon film), and on the gate insulation film, a gate wiring layer PLYB (a gate electrode in the TFT element 46) covers. The gate wiring layer PLYB is a laminate of an N-type multi crystalline silicon film where donor atoms (phosphorous) are doped in a high concentration and a tungsten silicide film, and configures the scanning line 16.

On the gate wiring layer PLYB, a first interlayer insulation film ILD1 is formed of a silicon oxide film. On the first interlayer insulation film ILD1, a first metal layer MTLA is formed. The first metal layer MTLA is a laminate of titanium nitride, aluminum and titanium, and configures the signal line 17. The first metal layer MTLA forms one electrode of the lower side protection capacitor 31L in the protection capacitor unit 31A. The common electrode wiring 27L is extended to the first metal layer MTLA.

A second interlayer insulation film ILD2 is formed of a silicon oxide film so as to cover the first metal layer MLTA. On the second interlayer insulation film ILD2, a second metal layer MTLB is formed. The second metal layer MTLB is a laminate of aluminum and titanium, and configures the light blocking film 33 in the TFT unit 46A. The second metal layer MTLB forms the other electrode of the lower side protection capacitor 31L in the protection capacitor unit 31A, and also forms one electrode of the upper side protection capacitor 31U. The second constant potential wiring VSS2 is extended to the other electrode of the lower side protection capacitor 31L and concurrently one electrode of the upper side protection capacitor 31U formed of the second metal layer MTLB. Furthermore, the second metal layer MTLB forms the external connection terminal 37 in the external connection terminal unit 37A. On the other hand, the second interlayer insulation film ILD2 forms a dielectric film of the lower side protection capacitor 31L in the protection capacitor unit 31A. A thickness of the second interlayer insulation film ILD2 is 400 nm.

A third interlayer insulation film ILD3 is formed of a silicon oxide film to which phosphorous and boron are added so as to cover the second metal layer MTLB. On the third interlayer insulation film ILD3, a third metal layer MTLC is formed. The third metal layer MTLC is a laminate of aluminum and titanium, and forms one electrode of the retention capacity 48 in the TFT unit 46A. The third metal layer MTLC forms the other electrode of the upper side protection capacitor 31U in the protection capacitor unit 31A. The common electrode wiring 27L is extended to the third metal layer MTLC. On the other hand, the third interlayer insulation film ILD3 forms a dielectric film of the upper side protection capacitor 31U in the protection capacitor unit 31A. A thickness of the third interlayer insulation film ILD3 is 400 nm. In this way, the protection capacitor 31 is formed as a laminate of the upper side protection capacitor 31U and the lower side protection capacitor 31L in a cross-sectional view. Furthermore, in the protection capacitor 31, in a case where the common electrode wiring 27L is disposed on the electro-optic material side compared to the second constant potential wiring VSS2 in a cross-sectional view, then the electro-optic material is interposed between the common electrode wiring 27L of the element substrate 12 and the common electrode 27 of the opposing substrate 13, thus, almost no electric field is applied. That is, almost no normal electric field is applied to the electro-optic material and no DC electricity flows in the electro-optic material. As a result, it is possible to prolong the durability of the electro-optic material. In addition, the retention capacity 48 in the TFT 46A is formed on the third interlayer insulation film ILD3, and has a high-dielectric-constant insulating film HKD as a dielectric film having a higher dielectric constant than the first interlayer insulation film ILD1, the second interlayer insulation film ILD2 and the third interlayer insulation film ILD3, and has the fourth metal layer MILD as the other electrode of the retention capacity 48. The fourth metal layer MTLD is an electrode in contact with the vertical conduction material in the vertical conduction unit 19A.

A fourth interlayer insulation film ILD4 is formed of a silicon oxide film to which phosphorous and boron are added so as to cover the third metal layer MLTC or the fourth metal layer MLTD. On the fourth interlayer insulation film ILD4, a transparent conductive film made of indium tin oxide ITO is formed. The transparent conductive film acts as the pixel electrode 42 in the pixel 35 and acts as a region of forming the sealing material 14 in the protection capacitor unit 31A. That is, the sealing material 14 is formed on the transparent conductive film which is formed on the protection capacitor unit 31A, and bonds the element substrate 12 and the opposing substrate 13. In the region surrounded by the sealing material 14 between the element substrate 12 and the opposing substrate 13, the liquid crystal layer 15 is disposed. The vertical conduction material allows the electrode connected to the common electrode wiring 27L of the element substrate 12 and the common electrode 27 of the opposing substrate 13 to conduct each other.

Planar Structure of Protection Capacitor

Figure 8:
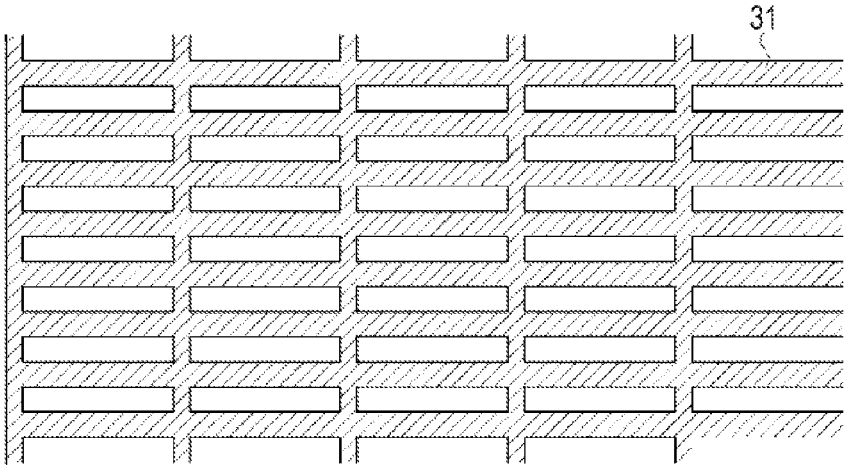
FIG. 8 is a schematic plan view of the liquid crystal device.

FIG. 8 is a schematic plan view of the liquid crystal device. Hereafter, a planar structure of the protection capacitor 31 will be described with reference to FIG. 8.

As illustrated in FIG. 8, the protection capacitor 31 is formed in a banded shape or a lattice shape in a plan view. That is, in a plan view, the region where the second metal layer MTLB or the third metal layer MTLC which form the protection capacitor 31 and the fourth metal layer MILD are overlapped with one another, is formed as a banded shape or a lattice shape, and a gap through which the light transmits is provided between the metal layers. As described above, since a metal electrode is used in the protection capacitor 31, the light is not transmitted. According to the configuration illustrated in FIG. 8, even though the protection capacitor 31 and the sealing material 14 are overlapped, the light transmits the banded-shaped or lattice-shaped gap, thus, it is possible to use photo-curable resin as the sealing material 14. That is, a typical ultraviolet curable resin can be used as the sealing material 14, and the manufacturing process is not needed to change. In addition, the high quality image display can be performed, and the electro-optic device having a high electrostatic resistance can be realized.

Comparative Example of Circuit Block Configuration

Figure 11:
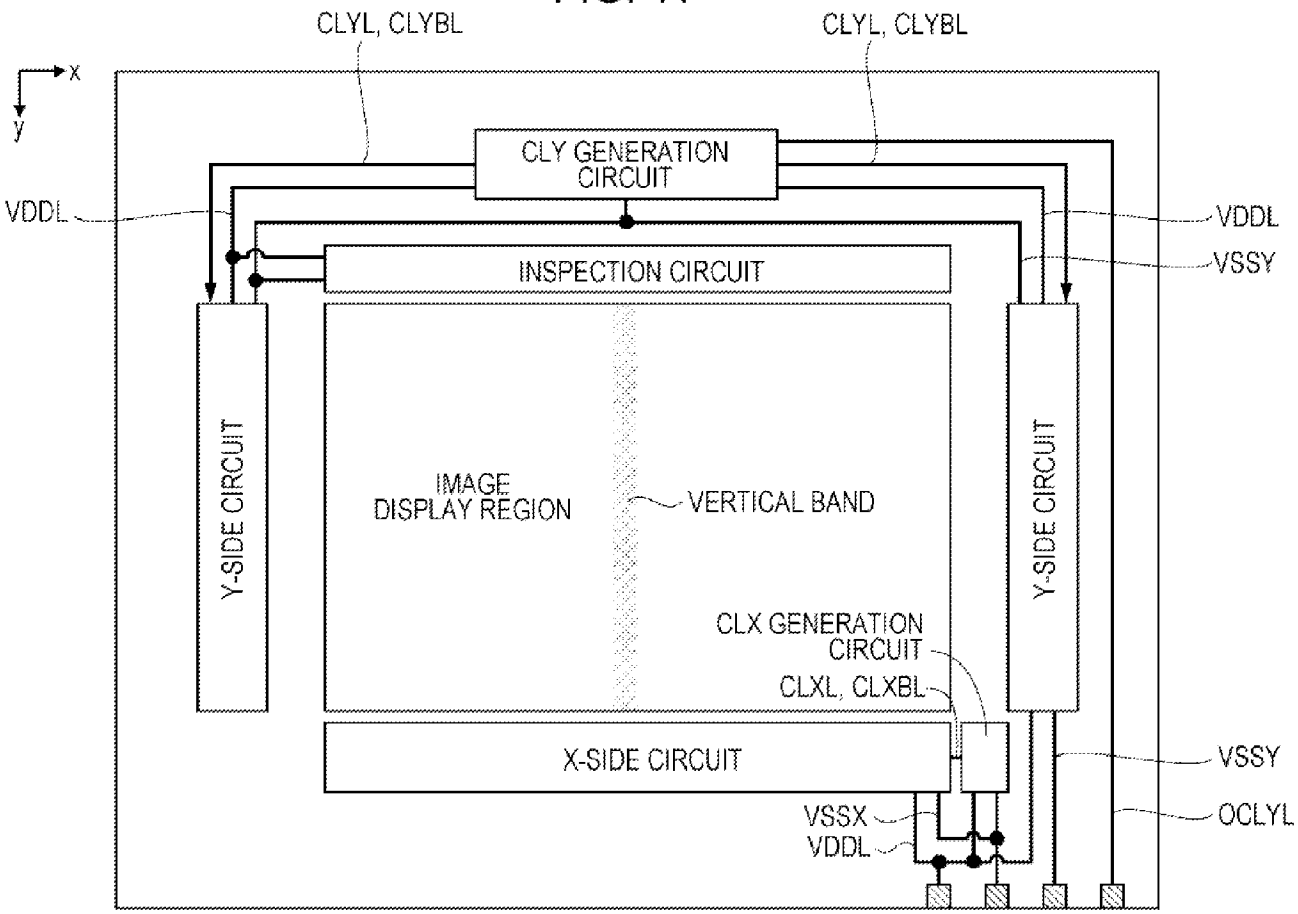
FIG. 11 is a schematic plan view illustrating a circuit block configuration of the liquid crystal device according to a comparative example.

FIG. 11 is a schematic plan view illustrating a circuit block configuration of the liquid crystal device according to the comparative example. Next, the effects of the electro-optic device in the embodiment 1 will be described with reference to the comparative example illustrated in FIG. 11.

In the comparative example illustrated in FIG. 11, the negative power source line for Y VSSY is wired between a Y-side circuit and the CLY generation circuit 20, and the negative power source line for X VSSX is wired between a X-side circuit and the CLX generation circuit 30. In a case where the Y clock signal is switched, and a large current is required due to the clock buffer circuit in the CLY generation circuit, there is possibility that a noise may be placed on the negative power source line for Y VSSY. Generally, in the liquid crystal device, in a case where the display method in which the scanning line is selected two by two lines as disclosed in JP-A-2012-49645, the Y clock signal is switched to and from the first state and the second state in the middle of one horizontal period. That is, in the middle of one horizontal period, the Y clock signal is switched from the first state to the second state or from the second state to the first state. During this switching, when the noise is placed on the negative power source line for Y VSSY, as illustrated in FIG. 11, a vertical band, which bisects the image display region in the horizontal direction, is generated. That is because, at the moment Y clock signal is switched, the potential of the scanning line in the non-selected state is increased from the negative power source potential VSS due to the increase of the potential of the negative power source line for Y VSSY from the negative power source potential VSS, and the image signal supplied to the signal line is deviated by the capacity coupling of the scanning line and the signal line.

On the contrary, in the electro-optic device in the embodiment illustrated in FIG. 1, since the first constant potential wiring VSS1 and the second constant potential wiring VSS2 are electrically separated, almost no noise is placed on the first constant potential wiring VSS1. As a result, the cause of defects on display as illustrated in FIG. 11 of the comparative example is suppressed. In other words, it is possible to realize the electro-optic device which performs a high quality displaying.

Furthermore, in the embodiment, the description is made using the liquid crystal device 100 as the electro-optic device. However, besides this, an organic EL device or the electrophoretic display device may be subject to the description of the electro-optic device.

Electronic Apparatus

Figure 9:
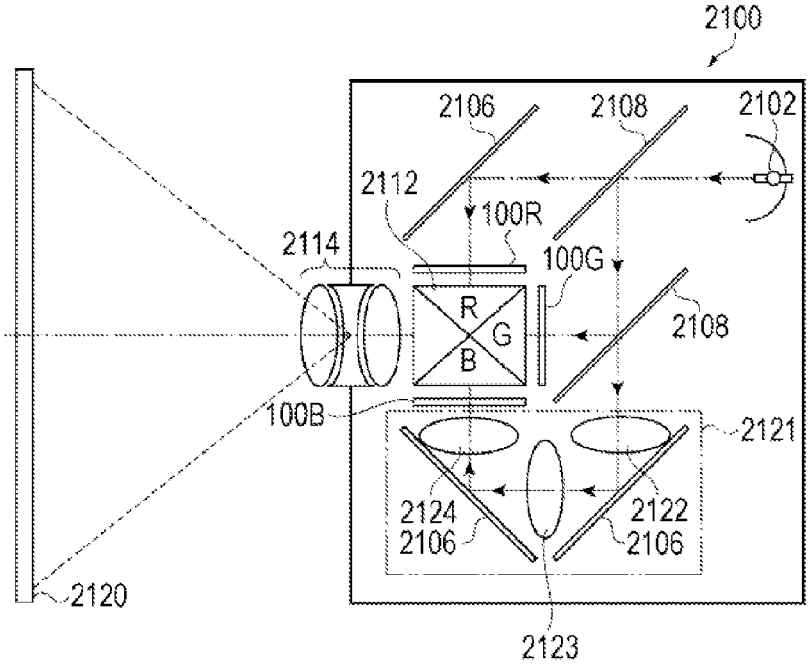
FIG. 9 is a plan view illustrating a configuration of a three board type projector as an electronic apparatus.

FIG. 9 is a plan view illustrating a configuration of a three board type projector as an electronic apparatus. Next, the projector as an example of the electronic apparatus in the embodiment will be described with reference to FIG. 9.

In the projector 2100, light emitted from the light source 2102 composed of ultra-high pressure mercury lamp is divided into three primary colors of light, red (R), green (G) and blue (B) by three sheets of mirrors 2106 and two sheets of dichroic mirrors 2108, and is guided to the liquid crystal devices corresponding to each primary color, 100R, 100G and 100B. In addition, since an optical path of the blue light is long compared to the other lights, red or green, in order to avoid a loss, the blue light is guided via a relay lens system 2121 formed of an incident lens 2122, relay lens 2123 and an emitting lens 2124.

The liquid crystal devices 100R, 100G and 100B have configurations as described above, and are respectively driven by image signal corresponding to each color of red, green and blue supplied from the external apparatus (not illustrated).

The lights respectively modulated by the liquid crystal devices 100R, 100G and 100B are incident to a dichroic prism 2112 from three directions. Then, in the dichroic prism 2112, the lights with red and blue colors are refracted in 90 degree, and the light with green color goes straight. The light representing the color image which is synthesized in the dichroic prism 2112 is enlarged and projected by a lens unit 2114 to display a full color image on the screen 2120.

In addition, while a transmission image of the liquid crystal device 100R and 100B is projected after the reflection by the dichroic prism 2112, a transmission image of the liquid crystal device 100G is projected as it is. Therefore, the configuration is set so that the relationship of the image formed by the liquid crystal device 100R and 100B and the image formed by the liquid crystal device 100G are in a horizontally inverted relationship.

Since the liquid crystal devices 100R, 100G and 100B are used in the projector 2100 in the embodiment, it is possible to project the full color image with a bright and high definition and eventually a high image quality.

As the electronic apparatus, besides the projector described with reference to FIG. 9, a rear projection type television set, a direct-view television set, a mobile phone, a mobile audio device, a personal computer, a monitor for a video camera, a car navigation system, a pager, an electronic diary, an electronic calculator, a word processor, a workstation, a videophone, a POS terminal, a digital still camera and the like may be considered. Then, the electro-optic device described in the embodiment may be applied with respect to these electronic apparatuses.

Embodiment 2

Embodiment where Number of Wirings be Reduced

Figure 10:
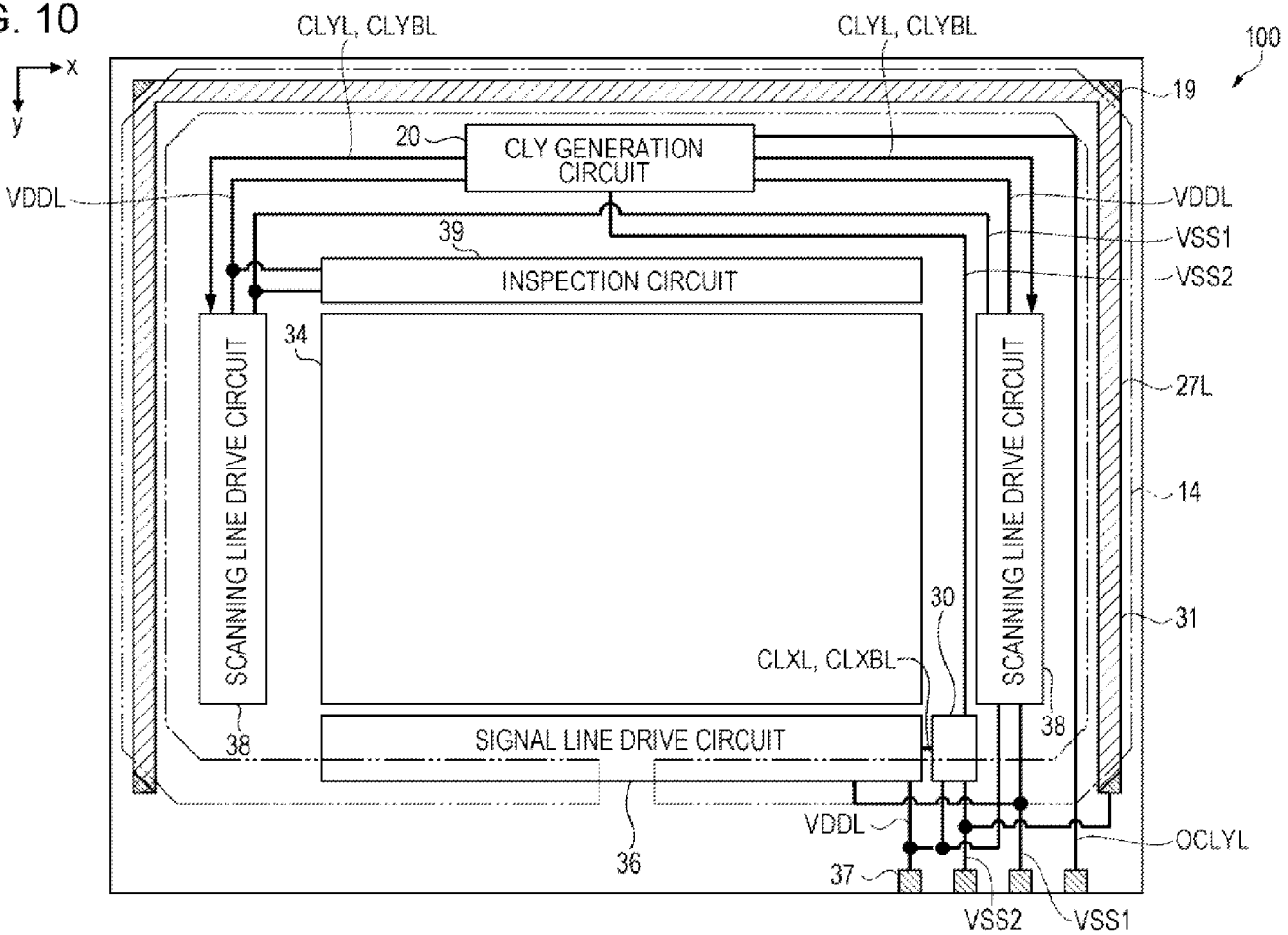
FIG. 10 is a circuit block diagram describing an outline of a liquid crystal device according to the embodiment 2.

FIG. 10 is a circuit block diagram describing an outline of the liquid crystal device according to the embodiment 2.

Hereafter, a configuration of the electro-optic device in the embodiment with reference to FIG. 10 will be described. In addition, the same reference numerals are given to the same configuration part as in the embodiment 1, and a duplicated description will not be repeated.

The difference in the embodiment (FIG. 10) compared to the embodiment 1 (FIG. 1) is in a point that the number of wirings is decreased. The other configurations are almost the same as that of the embodiment 1. In the embodiment 1 (FIG. 1), the first constant potential wiring VSS1, the second constant potential wiring VSS2 and the third constant potential wiring VSS3 are electrically separated in the electro-optic device. On the contrary, in the embodiment, the first constant potential is supplied to various circuits by the first constant potential wiring VSS1 and the second constant potential wiring VSS2. That is, to the signal line drive circuit 36, the first constant potential is supplied from the first constant potential wiring VSS1. In this way, since the first constant potential wiring VSS1 which supplies the first constant potential to the scanning line drive circuit 38 and the signal line drive circuit 36, and the second constant potential wiring VSS2 which supplies the first constant potential to the clock buffer circuit 203 are electrically separated in the electro-optic device, for example, even the potential of the second constant potential wiring VSS2 changes, the potential of the first constant potential wiring VSS1 can be kept in a normal range. That is, it is possible to suppress the power variation noise due to the switching of the clock signal from being placed on the scanning line drive circuit 38 and the signal line drive circuit 36. As a result, a disturbance of the displayed image can be suppressed, and the high quality image display can be performed. In addition, the number of external connection terminals 37 can be reduced compared to the embodiment 1.

As described above, according to the embodiment, in addition to the effects in the embodiment 1, the number of external connection terminals 37 can be reduced.

Furthermore, the invention is not limited to the embodiments described above. Various modifications or improvements may be added to the embodiments described above. A modification example will be described below.

Modification Example 1

Example where Configuration of Protection Capacitor is Different

The electro-optic device in the modification example will be described using FIG. 1. In addition, with the same reference numerals given to the same configuration parts as in the embodiments 1 to 2, a duplicate description will not be repeated.

Compared to the embodiments 1 to 2 of the invention, the modification example has a difference in configuration of the protection capacitor 31. Other configurations are almost the same as the embodiments 1 to 2. In the embodiments 1 to 2, the second constant potential wiring VSS2 and the common electrode wiring 27L are extended to the protection capacitor unit 31A to configure the protection capacitor 31 by interposing the interlayer insulation film. On the contrary, in the modification example, the second constant potential wiring VSS2 is extended to one electrode of the protection capacitor 31, and the fourth constant potential wiring VDDL is extended to the other electrode of the protection capacitor 31. As described above, the first power source and the second power source are the negative power source or the positive power source. On the other hand, when the Y clock signal CLY and the Y clock bar signal CLYB are switched, the clock buffer circuit 203 performs discharging of the transistor capacity so as to increase the negative power source potential VSS, and performs charging of the transistor capacity so as to decrease the positive power source potential VDD. According to the configurations in the modification example, since the protection capacitor 31 is formed on the fourth constant potential wiring VDDL and the second constant potential wiring VSS2, when the negative power source potential VSS is increased, the positive power source potential also increases. Conversely, when the positive power source potential VDD is decreased, the negative power source potential VSS also decreases. Therefore, the charging and discharging of the transistor capacity exert the opposite effects respectively, the increase of the negative power source potential and the decrease of the positive power source potential is offset. That is, it is possible to improve the electrostatic resistance of the fourth constant potential wiring VDDL and the second constant potential wiring VSS2, and to significantly reduce the noise which is placed on the power source wiring by the clock buffer circuit 203.

As described above, according to the modification example, in addition to the effects of the embodiments 1 to 2, the occurrence of the noise in the power source due to the clock buffer circuit 203 can be suppressed.

This application claims priority from Japanese Patent Application No. 2012-150347 filed in the Japanese Patent Office on Jul. 4, 2012, the entire disclosure of which is hereby incorporated by reference in its entirely.

What is claimed is:

1. An electro-optic device comprising:

a scanning line;

a signal line that intersects the scanning line;

a scanning line drive circuit that supplies a selected potential or a non-selected potential to the scanning line;

a pixel switching element that is provided corresponding to the intersection of the scanning line and the signal line, being in a conductive state in a case where the selected potential is applied to the scanning line and being in a non-conductive state in a case where the non-selected potential is applied to the scanning line;

a clock buffer circuit that waveform-shapes a clock signal supplied to the scanning line drive circuit;

a first wiring that supplies a first constant potential to the scanning line drive circuit; and a second wiring that supplies the first constant potential to the clock buffer circuit, wherein the first wiring and the second wiring are electrically separated from each other.

2. The electro-optic device according to claim 1, further comprising:

a signal line drive circuit that supplies an image signal to the signal line; and a third wiring that supplies the first constant potential to the signal line drive circuit, wherein the first wiring, the second wiring and the third wiring are electrically separated from one another.

3. The electro-optic device according to claim 1, comprising:

the signal line drive circuit that supplies the image signal to the signal line, wherein the first constant potential is supplied to the signal line drive circuit from the first wiring.

4. The electro-optic device according to claim 1,
wherein a protection capacitor is formed, and
wherein the second wiring is electrically connected to the protection capacitor.

5. The electro-optic device according to claim 4, comprising:
a rectangular display region,
wherein the protection capacitor is formed outside the display region along three sides of the display region.

6. The electro-optic device according to claim 4, comprising:
an element substrate;
an opposing substrate; and
a sealing material bonding the element substrate and the opposing substrate,
wherein the sealing material is disposed along the outer edge portion of the element substrate, and
wherein the protection capacitor and the sealing material are at least partially overlapped with each other in a plan view.

7. The electro-optic device according to claim 6,
wherein the protection capacitor is formed in a banded shape in a plan view.

8. The electro-optic device according to claim 4,
wherein an interlayer insulation film is formed, and
wherein a dielectric film of the protection capacitor is the interlayer insulation film.

9. The electro-optic device according to claim 4,
wherein a common electrode wiring is formed, and
wherein the second wiring is extended to one electrode of the protection capacitor, and the common electrode wiring is extended to the other electrode of the protection capacitor.

10. The electro-optic device according to claim 4,
wherein a fourth wiring that supplies the second constant potential which is different from the first constant potential is formed, and
wherein the second wiring is extended to one electrode of the protection capacitor, and the fourth wiring is extended to the other electrode of the protection capacitor.

11. The electro-optic device according to claim 4,
wherein a capacitance amount of the protection capacitor is equal to or higher than three pico Farad.

12. An electronic apparatus comprising:
the electro-optic device according to claim 1.

* * * * *